US010934647B2

(12) United States Patent
Tallmadge et al.

(10) Patent No.: US 10,934,647 B2
(45) Date of Patent: Mar. 2, 2021

(54) ATTACHMENT FOR SEALING SEAMS

(71) Applicant: SECO Systems, LLC, Fall River, MA (US)

(72) Inventors: John Tallmadge, Tiverton, RI (US); William Vahle, Lenox, MA (US); Lukas Scheurer, Providence, RI (US); Roxanne Ferreiro, Weston, MA (US); Manuel Avila, North Dighton, MA (US)

(73) Assignee: SECO Systems, LLC, Fall River, MA (US)

( * ) Notice: Subject to any disclaimer, the term of this patent is extended or adjusted under 35 U.S.C. 154(b) by 348 days.

(21) Appl. No.: 15/932,105

(22) Filed: Feb. 5, 2018

(65) Prior Publication Data

US 2019/0242044 A1 Aug. 8, 2019

(51) Int. Cl.

| | |
|---|---|
| ***D05B 17/00*** | (2006.01) |
| ***D05B 19/16*** | (2006.01) |
| ***D05B 35/06*** | (2006.01) |

(52) U.S. Cl.

CPC ..... *D05B 17/00* (2013.01); *D05B 19/16* (2013.01); *D05B 35/06* (2013.01); *D05D 2209/10* (2013.01); *D05D 2305/26* (2013.01)

(58) Field of Classification Search

CPC ..... D05B 71/00; D05B 35/06; D05B 17/00; D05B 19/06; D05D 2305/26; D05D 2209/10

See application file for complete search history.

(56) References Cited

U.S. PATENT DOCUMENTS

| | | | | |
|---|---|---|---|---|
| 1,560,712 A | | 11/1925 | Naylor | |
| 2,115,368 A | | 4/1938 | Lustberg | |
| 2,465,374 A | | 3/1949 | Haman et al. | |
| 2,702,067 A | | 2/1955 | Goldberg | |
| 3,272,682 A | | 9/1966 | Balamuth | |
| 3,457,739 A | | 7/1969 | Frand | |
| 4,016,822 A | * | 4/1977 | Pugliese | D05B 35/02 112/217 |
| 4,417,535 A | * | 11/1983 | Hannemann | D05B 27/10 112/304 |
| 4,483,266 A | * | 11/1984 | Olasz | D05B 3/06 112/304 |
| 4,604,152 A | | 8/1986 | Liukko | |
| 4,605,578 A | | 8/1986 | Emrich et al. | |

(Continued)

FOREIGN PATENT DOCUMENTS

JP 2017-0185766 10/2017

*Primary Examiner* — Nathan E Durham
(74) *Attorney, Agent, or Firm* — Michael de Angeli

(57) ABSTRACT

An attachment for a sewing machine to provide simultaneous sewing and sealing of a seam comprises a reel for dispensing a strip of adhesive thermoplastic polymer between fabric members to be sewn. A plurality of heated driven rollers opposed to heated idler rollers having a continuous belt thereover collectively exert heat and pressure on the seam, melting the polymer strip so as to seal the seam. Thread having been treated with adhesive thermoplastic polymer may be employed to seal the punctures in the fabric made by the sewing machine's needle. The driven rollers are driven in synchronization with the operation of the sewing machine, and are engaged with and withdrawn from the seam responsive to operator command.

8 Claims, 8 Drawing Sheets

(56) References Cited

U.S. PATENT DOCUMENTS

| | | | | |
|---|---|---|---|---|
| 5,003,902 | A | 4/1991 | Bestock et al. | |
| 5,159,719 | A | 11/1992 | Aumann | |
| 5,162,149 | A | 11/1992 | Reaney | |
| 5,670,577 | A | 9/1997 | Dawson, Jr. | |
| 5,869,182 | A | 2/1999 | Ebert | |
| 5,885,679 | A | 3/1999 | Yasue et al. | |
| 6,293,080 | B1 | 9/2001 | Nishihara | |
| 6,887,335 | B2 | 5/2005 | Biro et al. | |
| 7,695,579 | B2 | 4/2010 | Kramer et al. | |
| 9,889,598 | B2 | 2/2018 | Ferreiro | |
| 2003/0010439 | A1 | 1/2003 | Fenton | |
| 2003/0221765 | A1 | 12/2003 | Guilhem et al. | |
| 2004/0031571 | A1 | 2/2004 | Lin | |
| 2013/0048219 | A1* | 2/2013 | Ferreiro | B29C 65/7437 156/513 |
| 2014/0216633 | A1 | 8/2014 | McCue | |
| 2016/0214562 | A1 | 7/2016 | Kalandek | |
| 2016/0243755 | A1 | 8/2016 | Ferriero | |

* cited by examiner

ATTACHMENT FOR SEALING SEAMS

FIELD OF THE INVENTION

This invention relates to an attachment for an existing sewing machine, including an improved mechanism for pulling fabric members to be sewn to one another using thread comprising a thermoplastic polymer, together with a strip of the same or a different thermoplastic polymer, through a sewing machine while applying heat and pressure thereto, so as to sew the seam and melt the polymer to seal the seam in a single operation.

BACKGROUND OF THE INVENTION

Numerous products are made by sewing fabric members to one another, such as garments, tents, sails, backpacks, and the like. In many circumstances, these products are required to be highly water repellent and waterproof. As the needle used to drive thread through the fabric members in the sewing process is necessarily much larger in diameter than the thread, the needle punctures commonly tend to leak unless steps are taken to seal the seam. The spaces in the seam between needle punctures also tend to leak.

At present, the most prevalent method of sealing a sewn seam is to apply a wide tape of thermoplastic polymer with an adhesive layer over a previously sewn seam. The garment or other object is supplied to a machine provided with a pair of opposed rollers. A polymer substrate on the order of one inch wide with adhesive on one side thereof is heated by a stream of hot air, to activate the adhesive, and is then urged against the seam by the rollers so as to be adhered to the fabric members over the seam as the tape cools, covering the seam. Although this process is referred to in the art as "seam sealing", in fact the seam itself is not literally sealed but is simply covered by the tape.

This method of seam sealing has many drawbacks, perhaps most notably that it requires the seam to be sealed in a separate operation from the sewing of the seam. Clearly if the seam could be sewn and sealed in a single operation substantial economies would be realized in terms of reduced labor requirements, reduced floor space requirements, and reduced equipment costs. The application of the polymer tape also stiffens the seam in ways that can be uncomfortable and restrict the wearer's motion in the case of garments, and adds additional weight.

More recently, a new method for sealing seams has been developed, which is described in Ferreiro U.S. patent application Ser. No. 13/594,415 filed Aug. 24, 2012, incorporated herein by this reference, claiming priority from provisional application 61/575,602, filed Aug. 24, 2011, and published as publication No. 2013/0048219, and in copending continuation application Ser. No. 14/999,320, to issue Feb. 13, 2018 as U.S. Pat. No. 9,889,598. The Ferreiro applications describe a method for forming a waterproof seam while sewing the seam by employing a thread comprising a quantity of thermoplastic polymer and heating the seam while applying pressure, melting the polymer so as to fill the punctures. A strip of thermoplastic polymer can also be inserted between the fabric members during the sewing step and be bonded to the fabric members in the same step of applying heat and pressure, sealing the seam between the thread punctures.

Because the polymer-bearing thread and optional polymer strip are internal to the seam in the Ferreiro method of seam sealing, the practice of heating the polymer using a jet of hot air, as practiced in the prior art seam sealing practice, in which the polymer tape is applied to a previously-sewn seam, cannot be employed in the Ferreiro process. The Ferreiro application teaches that the heat and pressure can be applied to the seam using a heated roller opposed to a heated plate, and that the heated plate could be replaced by a roller. See para. [0031] of the published application. Ferreiro also teaches that a "puller" wheel could be provided to pull the fabric members joined by the seam through the sewing machine. See para. [0033] of the published application.

The present application relates to improvements in the mechanism and process described in the Ferreiro application, essentially taking it from the "proof-of-concept" status described therein to a fully commercialized device that can be attached readily to various commercial sewing machines. One particular improvement relates to the means of application of heat and pressure to seal the seam as it is being sewn.

SUMMARY OF THE INVENTION

One aspect of the present invention is to replace the heated roller opposed to a heated plate or to another heated roller of the Ferriero application with a series of driven heated rollers, typically three, opposed to pairs of heated idler rollers, with a belt disposed over the heated idler rollers, such that the belt urges the fabric members to be joined against the heated driven rollers. This ensures that the fabric members are in contact with the heated driven rollers long enough to ensure effective melting of the polymer, and thereby ensuring that the seam is effectively sealed.

Another improvement provided according to the present invention is driving the downstream roller slightly faster than the upstream rollers, slightly stretching the fabric while heating the seam, to ensure that the seam remains well-formed after the polymer cools and hardens.

Further detailed improvements provided by the present invention will be described below in connection with a preferred embodiment of the invention.

BRIEF DESCRIPTION OF THE DRAWINGS

The invention will be better understood by reference to the accompanying drawings, in which.

DETAILED DESCRIPTION OF THE PREFERRED EMBODIMENTS

Figure 1:
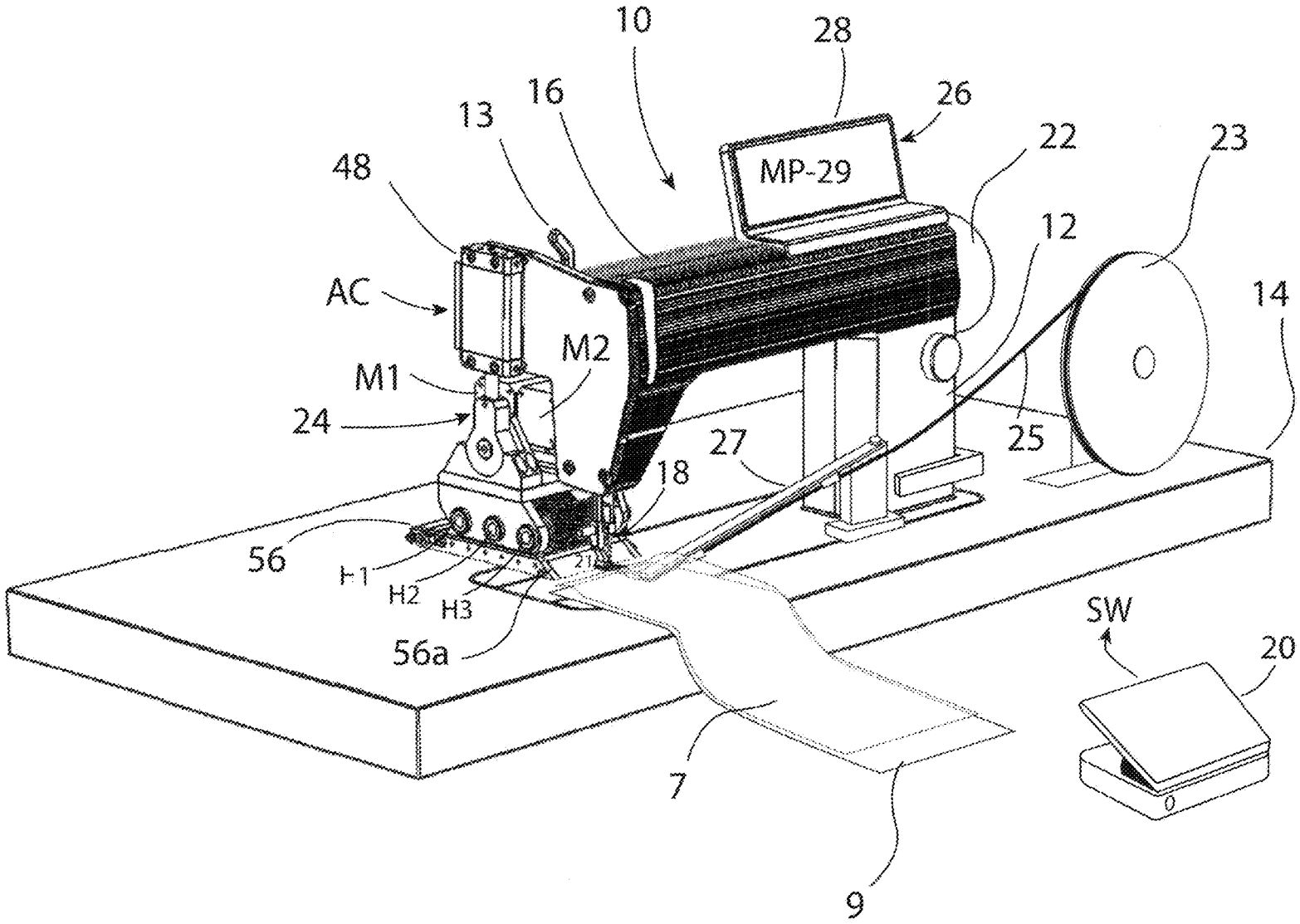
FIG. 1 shows a perspective view of the sewing machine, seen from the operator's side, with the attachment of the invention added thereto, and including a simplified schematic indication of control circuitry provided according to the invention.
Figure 2:
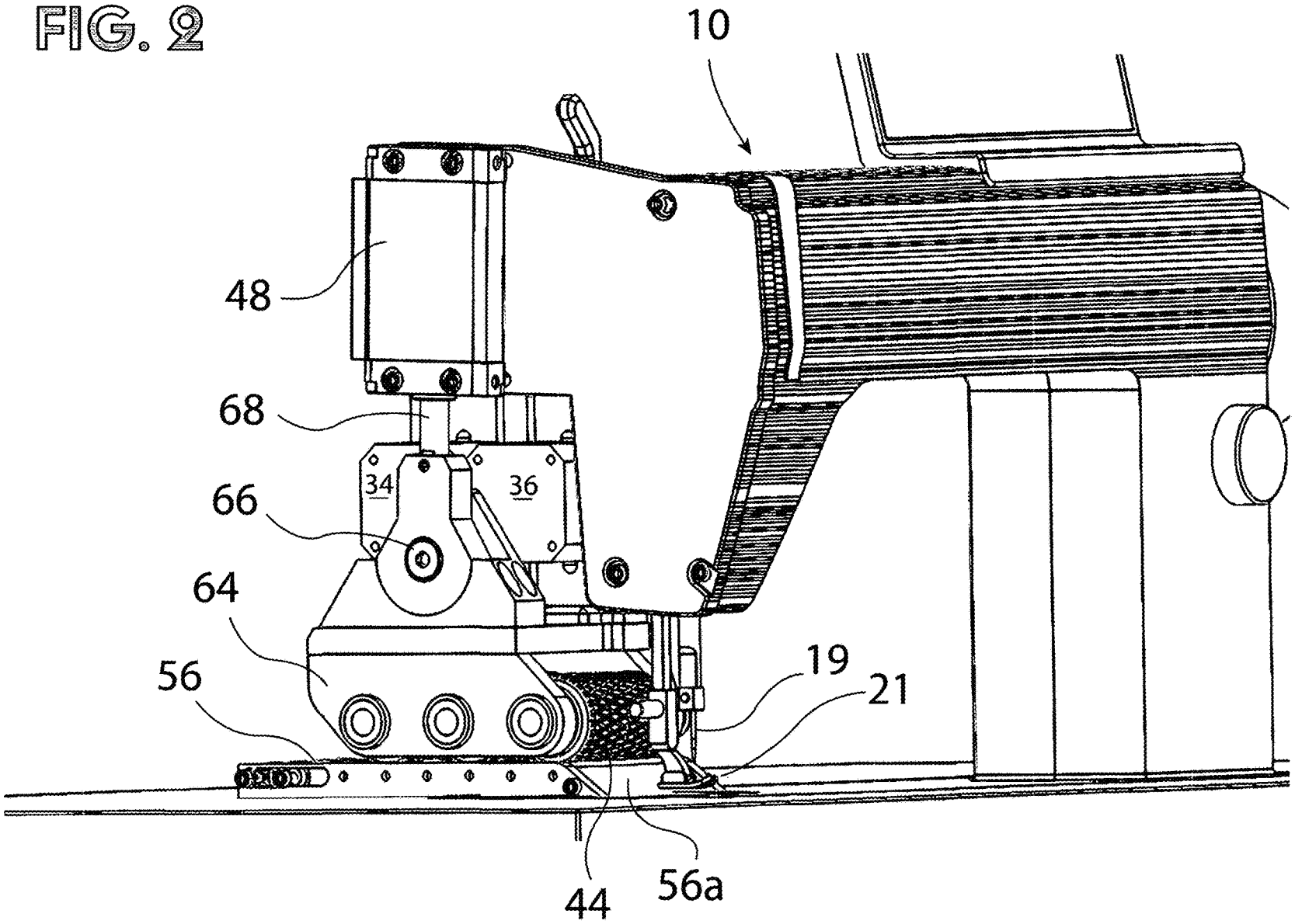
FIG. 2 shows an enlarged perspective view comparable to FIG. 1, illustrating the attachment of the invention in additional detail.

As indicated above, the invention relates to an attachment for an existing sewing machine that enables a seam to be sewn and sealed in a single operation. As shown by FIG. 1, a typical commercial sewing machine 10 comprises an upright column 12, in which runs a drive belt from a motor (not shown) disposed under a table 14, the motor being controlled by a foot switch 20 or the like, a transverse arm 16, a sewing mechanism 18, including a needle 19 and a presser foot 21 (see FIG. 2), a lever 13 for lifting the foot 21 out of engagement with fabric members 7 and 9 to be sewn to one another, and a flywheel 22. These components are well-known and their functions are not affected by the present invention, although certain of these are used in additional ways according to the invention, as will be detailed below.

Figure 8:
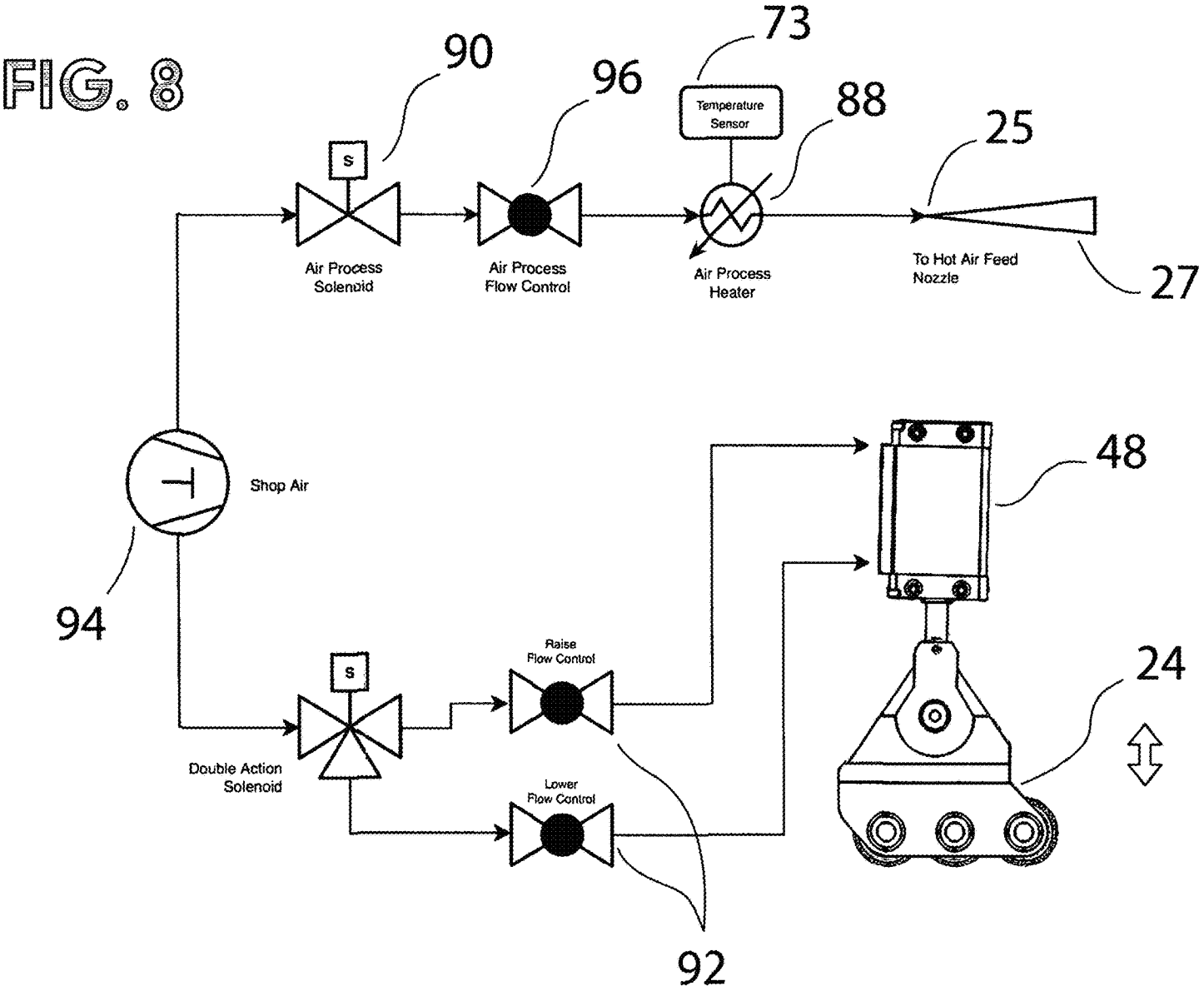
FIG. 8 is a schematic diagram of a compressed air system employed to move the driven rollers into engagement with the fabric members and to preheat the polymer strip.

According to the invention, an attachment 24 is attached to the sewing machine 10 by removing a cover plate (not shown) and assembling the attachment 24 in place of the cover plate. The details of this replacement of the cover plate by the attachment will of course vary somewhat from machine to machine; in each case, the attachment is designed so that the rollers (discussed further below) are disposed directly behind needle 19. Also added is a reel 23 dispensing a strip 25 of an adhesive thermoplastic polymer, and a feeder assembly 27 for directing the polymer strip 25 into the seam being sewn. As compared to the adhesive tape used in prior seam sealing operations, which may be one inch wide by 0.002-0.003 inches thick, the strip employed according to the invention may typically be ⅛-¼ inch wide by 0.010-0.020 inches thick, 0.014 inches being preferred. The feeder assembly 27 may be provided with a hot air duct and nozzle, to preheat the polymer strip 25 and activate its adhesive properties prior to its being sewn into the seam. FIG. 8 shows details of the air system used to preheat the polymer strip 25.

Further provided according to the invention is an electronic control unit 26, which may comprise a touch screen 28 for receiving user input concerning the parameters necessary to control the process of sealing the seam, such as the temperature of heated rollers that apply heat and pressure to the seam to melt the polymer and seal the seam, and a microprocessor 29 (indicated as a component of computer device 26 as "MP") for receiving these user inputs and other data, and for providing control signals to the various components of the attachment. FIG. 7 shows a block diagram of this circuitry. Also attached to the sewing machine 10 are a magnet 30 (see FIG. 6), mechanically affixed to the flywheel 22, and a Hall-effect sensor 32, likewise mechanically affixed to the upright column 12.

More specifically, as is well-known, in the process of sewing a seam, the sewing machine 10 advances the fabric members 7 and 9 to be sewn together incrementally, by the desired length of the stitch, and the presser foot 21 then holds them in place, so that the needle 19 can puncture the fabric members while stationary. In so doing flywheel 22 is rotated intermittently. As will be discussed in detail below, the attachment of the invention comprises heated rollers 40, 42, and 44 (see FIG. 4) that are driven to pull the fabric members through the attachment while applying heat and pressure to the seam so as to melt the polymer and seal the seam. In order to function properly, the driven rollers must cease pulling on the fabric members during the stitching process. In order that the operation of the rollers can be synchronized with that of the sewing machine, when the magnet 30 passes the Hall-effect sensor, the latter provides a signal ("HE" in FIGS. 6 and 7) that is provided to the microprocessor 29 to control two motors 34 and 36 via signals M1 and M2 (FIGS. 1 and 7) that drive the rollers. Signal HE is thus used to synchronize the operation of the rollers to the remainder of the sewing machine, so as to avoid distorting the fabric. The circuitry connecting the microprocessor 29 to the various components providing and receiving the signals noted is not shown in FIG. 1, for clarity of the drawing, but will be readily understood and easily implemented by those of skill in the art. As above, FIG. 7 shows a schematic diagram of this circuitry.

As noted, operation of the sewing machine is controlled by a foot pedal 20 or the like, such as a knee- or hand-operated switch operated by an operator. When the operator stops a given sewing operation, the heated rollers 40, 42 and 44 must be removed from the fabric members being sewn together in order to avoid scorching the fabric. Therefore a control signal SW from foot pedal 20 is provided to microprocessor 29 which in turn provides a control signal AC to an air cylinder 48. The assembly of rollers 40, 42, and 44 and of motors 34 and 36 is carried by air cylinder 48 and is withdrawn upwardly, out of engagement with the fabric members, when operation of the sewing machine 10 is stopped by the operator. At the same time the stream of hot air preheating the strip of polymer 25 is shut off. These operations are accordingly reversed when sewing is again initiated by the operator.

Figure 5:
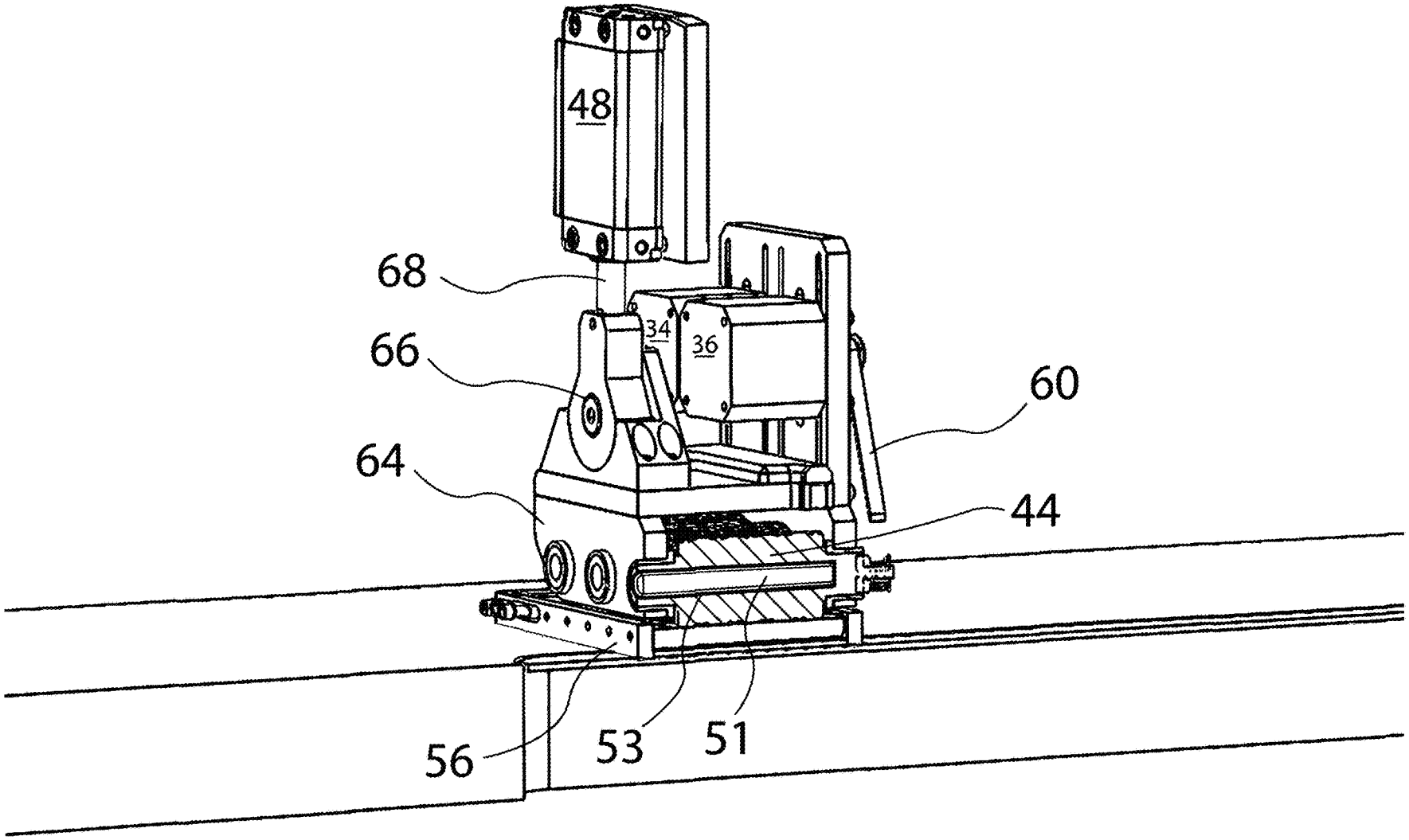
FIG. 5 shows a an enlarged perspective view comparable to FIG. 2, but of the attachment only, and with one of the rollers in section, showing the cartridge heaters used to heat the rollers.

The signals provided by microprocessor 29 also include three control signals H1, H2 and H3 provided to rollers 40, 42 and 44 respectively, to control their surface temperature and thereby the amount of heat applied to the seam. Control of the surface temperature of these rollers is clearly important to obtaining adequate melting of the polymer of the thread and strip to provide good sealing without scorching or burning the fabric. The surface temperature of the rollers can be measured directly using infrared sensors, if such can be found that are sufficiently durable, or the temperature can be controlled indirectly using a feedback loop. The rollers can be heated using internal cartridge heaters 51. See FIG. 5. Idler rollers 50 (discussed further below) are likewise heated.

More specifically, in order that electrical connections can be made to the cartridge heaters 51, they must be stationary, while driven rollers 40, 42 and 46 and idler rollers 50 must rotate freely over heaters 51. The heaters 51 are designed to expand when current is applied, typically so as to fit snugly into a hole bored in a volume of material to be heated. In order that such expansion does not prevent rotation of the rollers, the cartridge heaters can be disposed in sections 53 of steel tubing, while the rollers may be made of aluminum, bored to be a sliding fit over the steel tubes, and assembled with a small quantity of heat-conducting grease therebetween. The greater coefficient of thermal expansion of aluminum as compared to that of steel will prevent the heating of the cartridge heaters 51 from interfering with rotation of the rollers.

As mentioned, the temperatures of the surfaces of the rollers can be measured directly using infrared sensors, if suitably durable components can be found. Alternatively, thermocouples can be provided to measure the temperatures of the cartridge heaters 51, and this data used in a well-known proportional-integral-derivative (PID) feedback loop to control the temperatures of the surfaces of the rollers. Experimentation and appropriate testing will be required to determine the optimal parameters for the PID feedback loop, and these will likely vary with differing fabric types to be sewn and sealed to one another according to the invention. Such experimentation and testing to calibrate the feedback loop is within the skill of the art.

Figure 3:
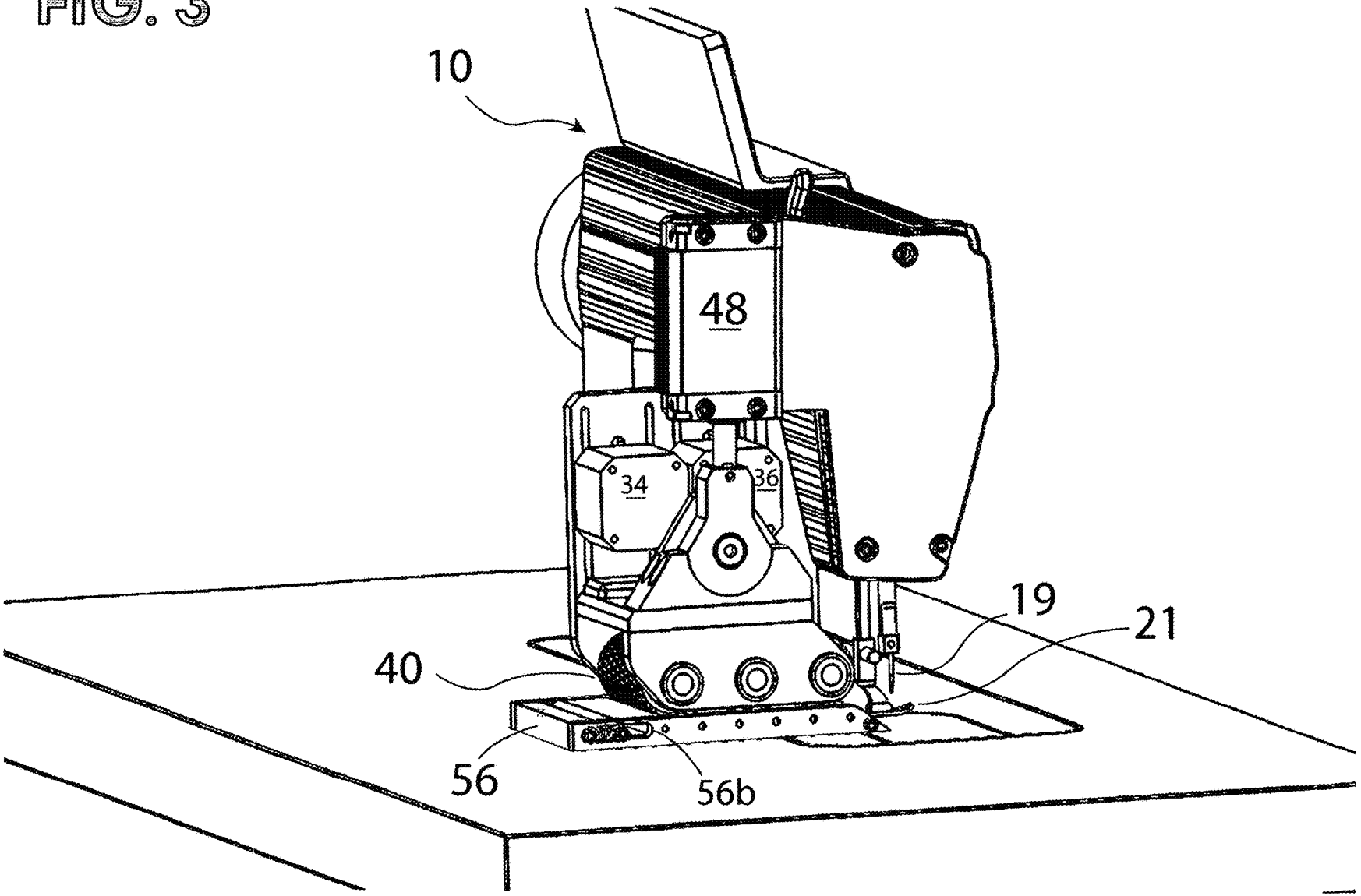
FIG. 3 shows an enlarged perspective view comparable to FIG. 2, but taken from a point towards the rear of the sewing machine.
Figure 4:
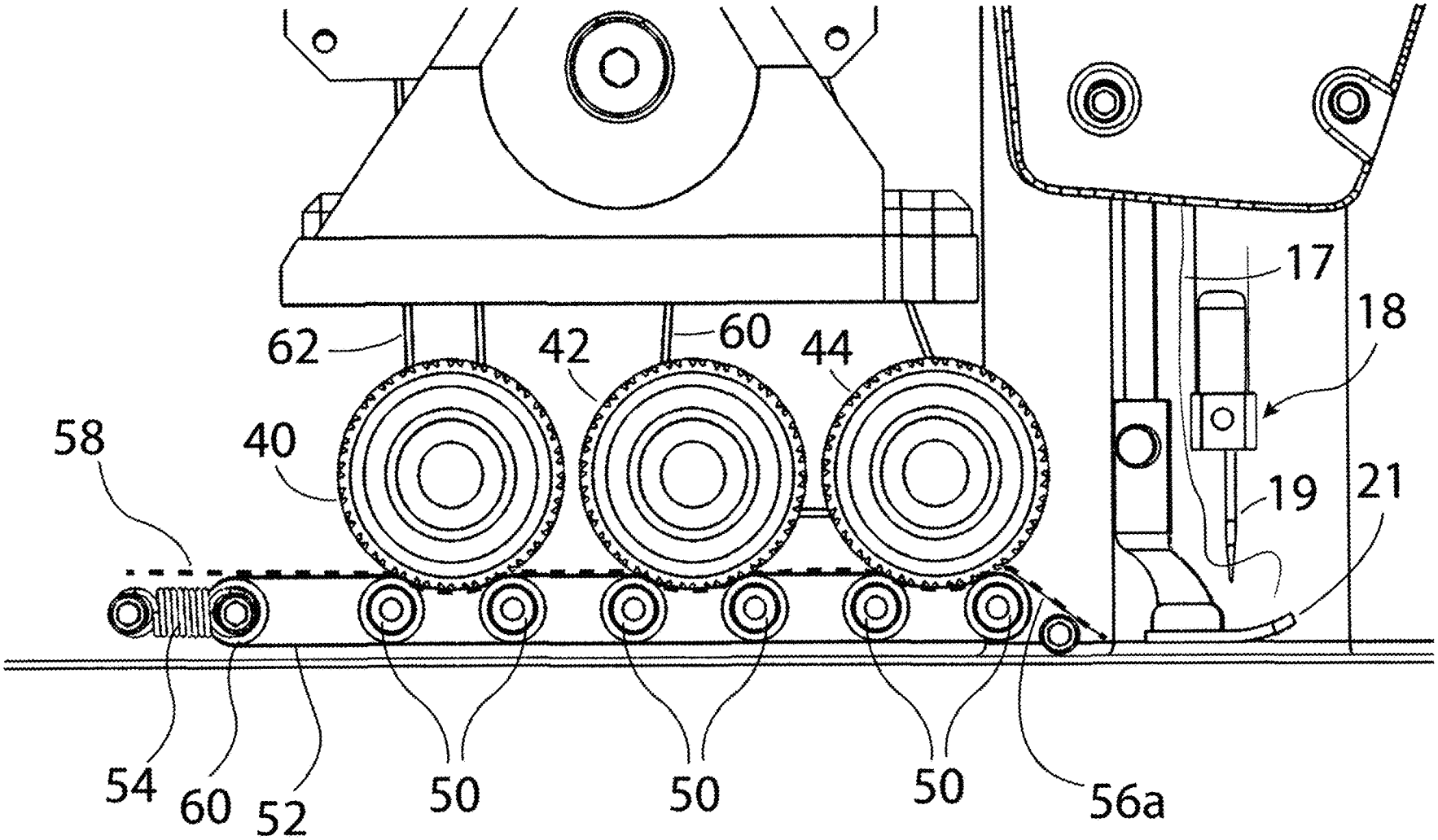
FIG. 4 shows an enlarged elevation of the upper and lower rollers from one side, with the belt passing therebetween.

Turning now to the detailed mechanical details of the attachment of the invention, FIG. 4 shows an end view of the assembly of driven heated rollers 40, 42 and 44, heated idler rollers 50, and belt 52 in detail; FIGS. 2, 3, 5 and 6 show further features provided according to the invention. Rollers 50 are carried by a chassis 56 that is assembled to the sewing machine 10, typically by attachment to the hinge (not shown) conventionally provided to allow the sewing machine to be pivoted out of its "nest" in the sewing machine table 14. FIG. 4 is effectively taken from inside chassis 56, so as to show the ends of rollers 50. Chassis 56 has an inclined leading surface 56*a* (see FIG. 2) that assists in feeding the sewn fabric members from beneath presser foot 21 to between the driven rollers 40, 42 and 44 and the idler rollers 50. FIG. 4 also shows the thread 17, which will typically be the polymer-coated thread described in the Ferreiro applications. Chassis 56 is preferably spaced from the sewing machine 10 by insulating spacers (not shown) to allow air to pass there between and avoid overheating the sewing machine 10.

A continuous belt 52 fits over rollers 50, and moves together with the fabric members 7 and 9 to be sewn, which are indicated by a heavy broken line 58 in FIG. 4. Belt 52 rides over a final, unheated roller 60, and is tensioned by springs 54 on either side of the chassis 56, biasing roller 60 (leftwardly in the view of FIG. 4) toward the "downstream" end of chassis 56; the degree of tension in belt 52 may be adjusted by provision of differing springs 54, or by adjustment of the preload provided. As indicated by FIG. 3, the biasing roller 60 is mounted in a slot 56*b* in chassis 56, to allow it to move to adjust the tension in belt 52.

As illustrated, the fabric members 7 and 9 to be bonded to one another are urged by belt 52 into engagement with rollers 40, 42, and 44 along a lower portion of the circumference of each of rollers 40, 42, and 44 between the opposed pairs of idler rollers 50, ensuring good heat transfer between rollers 40, 42, and 46 on the upper side, to the fabric members indicated at 58. By comparison, if belt 52 were omitted, heat transfer would end to take place only along lines at which the idler rollers 50 are juxtaposed to the driven rollers 40, 42, and 46, which would be much less effective. Belt 52 can be made of a composite of fiberglass cloth coated by one or more layers of Teflon® material. Given that these materials, as well as those of most fabrics, are relatively insulative, the extension of the heat transfer area provided by provision of the belt 52 is highly beneficial in ensuring sufficient heat transfer to effectively melt the polymer materials of the thread 17 and strip 25, and thereby effectively sealing the seam. Belt 52 also prevents the fabric members from being tangled in rollers 50.

In the preferred embodiment, the axes of driven rollers 40, 42, and 44 are coplanar, as are those of the idler rollers 50, as illustrated by FIG. 4. When the driven rollers are withdrawn upwardly, at the end of a sewing operation, the spring tension provided to unheated idler roller 60 by springs 54 will cause roller 60 to move leftwardly, so that belt 52 will take a straight-line path over the upper surfaces of idler rollers 50. When the driven rollers 40, 42, and 44 are brought back downwardly as sewing resumes, the belt 52 will be forced away from the straight-line path so as to conform to the lower circumferential surfaces of rollers 40, 42, and 44 between the respective pairs of idler rollers 50, taking the form shown in FIG. 4, while the springs 54 allow the unheated idler roller 60 to move rightwardly in the view of FIG. 4.

More specifically, as the fabric members with the polymer strip therebetween are drawn through the heated rollers, the heat and pressure provided by the rollers melts the preheated polymer strip 25 and squeezes it laterally, filling the space between the fabric members 7 and 9. Normally the practice of the invention will also involve the use of the polymer-laden thread 17 of the Ferriero applications, so that the polymer of the thread 17 is melted at the same time, filling the punctures left by the needle. However, it may be possible to avoid use of the thread 17 in favor of a plain thread, and simply filling the needle punctures with the polymer from the strip 25, and such is accordingly also within the scope of the invention. Likewise, in some applications the polymer strip 25 may be avoided and only the thread 17 used.

The polymers applied to the thread 17 and that of strip 25 may be the same or may differ. As of the filing of this application, experimentation is being performed to identify the optimal materials for these purposes. They may be as disclosed in the Ferreiro application, that is, thermoplastic polyurethane, or possibly materials selected from the group including nylon, polyester, polyolefin and vinyl, and mixtures and combinations thereof. It will be appreciated that these materials have good adhesive properties, so that the seam is strengthened as well as sealed by practice of the invention. The materials used in the prior art seam sealing processes may also be used. Preferably, the polymer is applied to the thread in a bath of molten polymer, so that the polymer is absorbed into the yarns of the thread, followed by passage through a die or the like, squeezing out extra polymer, so the final polymer content of the thread is 2-6% by weight, as in the Ferreiro applications.

Figure 6:
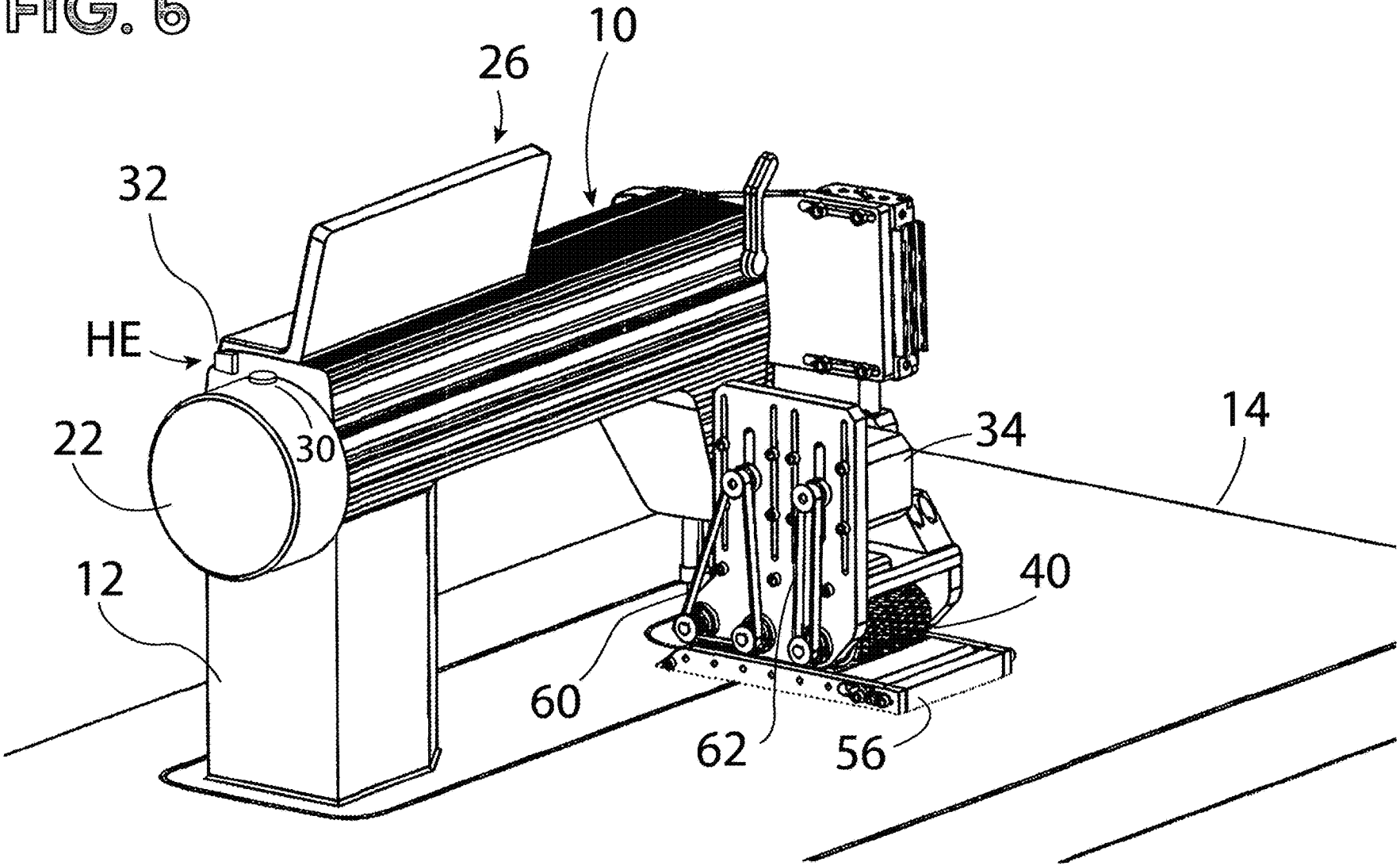
FIG. 6 shows a view from the rear of the sewing machine, showing belts used to drive the rollers, and also showing a magnet attached to the flywheel of the sewing machine and a cooperating Hall-effect sensor, used to synchronize operation of the attachment according to the invention to the sewing machine.
Figure 7:
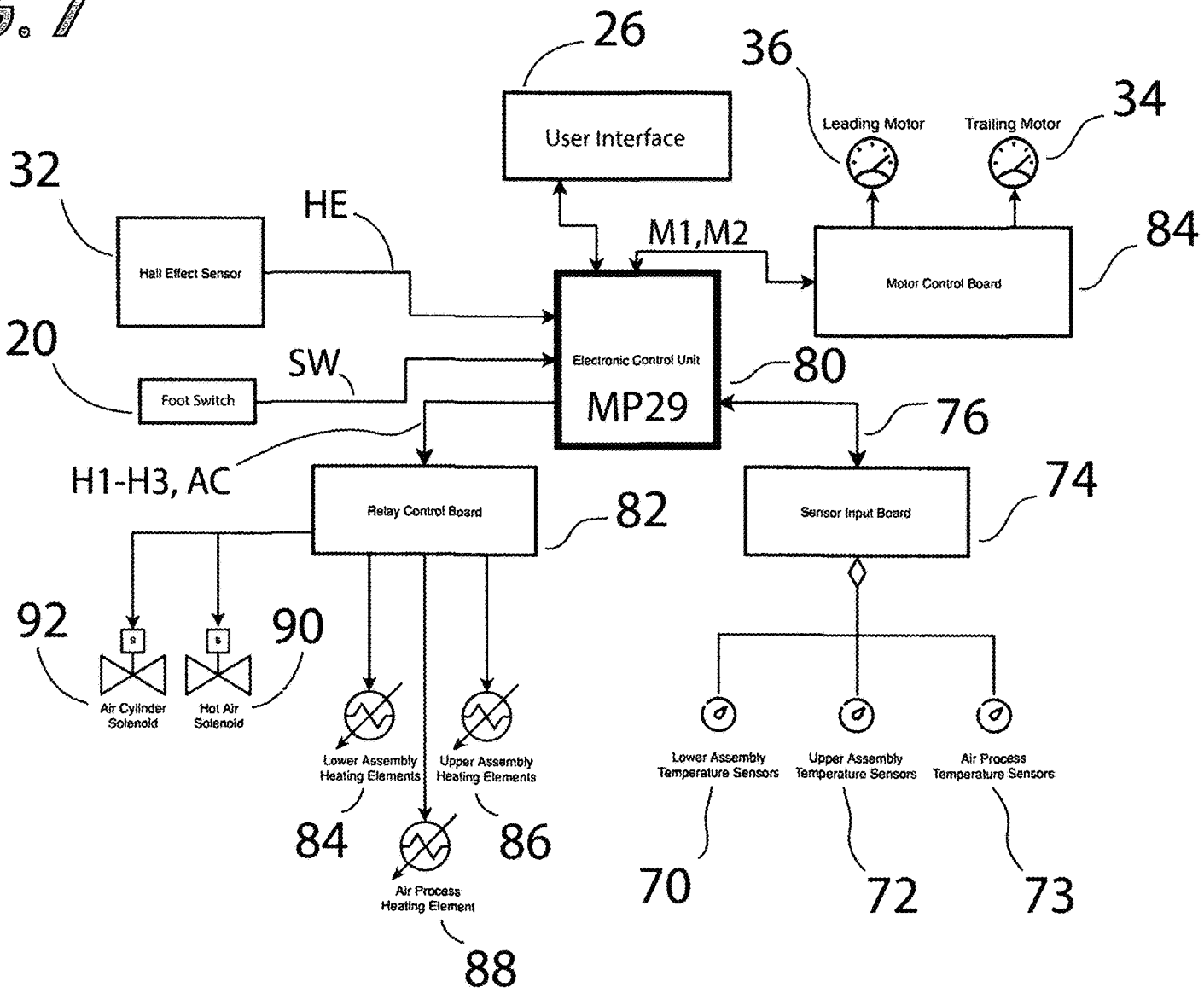
FIG. 7 is a schematic diagram of the electrical circuit provided according to the invention.

As shown in FIG. 6, the "upstream" rollers 42 and 44 are driven by motor 36 by way of a first belt 60, while the "downstream" roller 40 is driven separately by motor 34 by way of a second belt 62. The motors 34 and 36 are operated responsive to signals M1 and M2 (FIGS. 1 and 7) respectively, so that the rollers can be driven at different speeds as desired. Preferably, the downstream roller 40 is driven at a slightly higher speed than the upstream rollers 42 and 44, so as to exert tension on the assembly of fabric members while the polymer is being melted and the seam compressed, ensuring that the seam is properly formed.

Other preferred aspects of the design include the following:

The surfaces of driven rollers 40, 42, and 44 are knurled as illustrated, so as to ensure adequate friction between these surfaces and the fabric members 7 and 9. A coating is applied to produce a non-stick surface.

An operator-controlled cutter (not shown) may be provided between the rollers 40, 42, and 44 and presser foot 21, to cut the polymer strip 25 at the end of the seam.

Rollers 40, 42, and 44 are carried by a frame 64 (FIG. 2) that is pivoted transversely at 66 with respect to the moving actuator 68 of air cylinder 48. This pivoting allows the rollers to remain in contact with the fabric members 7 and 9 despite some degree of irregularity in the thickness of the fabric members, such as where several fabric members cross one another. The rollers 40, 42, 44 may also be carried on individual suspensions, spring-biased downwardly with respect to frame 64, for similar reasons.

As mentioned above, FIG. 7 is a schematic diagram of the electrical circuitry provided according to the invention. Where feasible, the components and control signals identified earlier are identified here as well. Thus, an electronic control unit (ECU) 80, which may comprise microprocessor 29 and associated supporting components, including a user interface such as touch screen 26, receives sensor inputs and provides control signals through appropriate interface circuit boards. Thus, for example, a set of temperature sensors 70 for the lower roller assembly, that is, idler rollers 50, a set of temperature sensors 72 for the driven rollers 40, 42, and 44, and an air process temperature sensor 73 for measuring the temperature of the stream of air preheating the polymer tape 25, each provide temperature data to a sensor input board 74. Sensor input board 74 then performs simple operations on the data, for example, analog-to-digital conversion, and provides the results to ECU 80 as indicated at 76. As discussed above, the signals responsive to roller temperature may represent direct measurement of the temperature of the rollers, or may represent measurement of the temperature of the cartridge heaters 51.

In either case, the temperature measurement signals are used by ECU 80 to generate temperature control signals by way of a well-known proportional-integral-derivative (PID) feedback loop. These control signals are then provided to a relay control board 82, which uses the control signals from ECU 80 to drive relays on board 82 to control supply of current to the various heating elements, including the lower assembly heating elements 84, that is, the cartridge heaters in idler rollers 50, the upper assembly heating elements 86, that is, the cartridge heaters in driven rollers 40, 42, and 44, and the air process heating element 88, heating the stream of air employed to preheat the polymer tape 25.

Similarly, the signal HE from the Hall-effect sensor 32 is provided to the ECU 80 and used to synchronize the operation of drive motors 34 and 36, by way of provision of signals M1 and M2 to a motor control board 84, which directly controls operation of motors 34 and 36. These motors may be of any of a variety of types; stepper motors are currently preferred.

Likewise, foot switch 20 provides signal SW to ECU 80, thereby indicating that sewing is to start or to stop. In response to a stop signal, ECU 80 provides signal AC to relay control board 82, which then operates the air cylinder via solenoid valve(s) 92 to lift the heated driven rollers 40, 42, and 44 out of engagement with the fabric members to be joined, and likewise operates hot air solenoid 90 to cut off the supply of hot air preheating polymer tape 25. While the fabric members 7 and 9 may remain in contact with belt 52 while rollers 40, 42, and 44 are thus withdrawn, out of engagement with fabric members 7 and 9, the fact that no pressure is then being exerted prevents the fabric from being scorched by heat from the idler rollers 50.

FIG. 8 shows as mentioned a schematic diagram of the pneumatic components employed. Compressed air is supplied at 94, and is supplied to a first solenoid valve 90 which controls flow of air for preheating the polymer strip 25. The pressure in the supply line is controlled by a regulator 96, and the air is heated by a heater 88. The heater is controlled by control unit 80 in response to a signal from sensor 73, as discussed above. The hot air impinges on the polymer strip 25 as it exits feeder 27, as illustrated.

A second stream of air is provided to solenoid valves 92, connected to air cylinder 48 as shown, in order to controllably raise and lower roller assembly 24 as desired.

Thus, in operation of the sewing machine with the attachment according to the invention, the sewing machine 10 is first preferably supplied with the polymer-bearing thread 17 (FIG. 4) according to the Ferreiro application referred to above. The polymer strip 25 is placed between the fabric members 7 and 9, and this assemblage is hand-fed under the presser foot 21. The foot switch 20 (or equivalent, such as a knee-operated lever switch) is then actuated by the operator, causing the sewing machine to operate as usual. At the same time, according to the invention, rollers 40, 42, and 44 are brought into engagement with the assemblage of fabric members and polymer strip 25, and are driven in synchronism with the operation of the sewing machine 10 to pull the assemblage between rollers 40, 42, and 44 and idler rollers 50, with belt 52 therebetween, so that the assemblage is heated to melt the polymer of tape 25 and that of the thread 17.

More specifically, the preheated polymer strip 25 is drawn into the machine between the two fabric members 7 and 9, the fabric members are stitched together, and a final application of heat to raise the polymer above its solid-to-liquid transition temperature is provided from the rollers. At the same time, the rollers also provide pressure, which flattens the seam, and squeezes the polymer in the seam between the needle punctures. The application of pressure also provides better heat transfer through the fabric to the polymer, as well as deforming the lower belt to give greater surface area for improved heat transfer efficiency. After exiting the roller assembly, the polymer rapidly cools and is set. At present, no separate cooling step appears necessary, but such is within the invention if needed.

It will be appreciated that while a single needle sewing a simple seam has been illustrated, other sewing operations, such as double-needle sewing or sewing of more complex seams, such as interlocking "felled" seams, may be readily accommodated. It will also be appreciated that the sewing machine could be used as usual, that is, without employment of the attachment of the invention, while it remains in place; that minimal modification of the sewing machine is needed to employ the attachment of the invention to simultaneously sew and seal seams; and that minimal operator training is needed.

While a preferred embodiment of the invention has been described in detail, the invention is not to be limited thereto, but only by the following claims.

What is claimed is:

1. A method for forming a waterproof seam between at least two fabric members, comprising the steps of:

providing a quantity of thread comprising between about 2% and about 6% by weight of a thermoplastic polymer selected from the group consisting of polyurethane, nylon, polyester, polyolefin, and vinyl;

employing a sewing machine to incrementally draw said at least two fabric members from an upstream side of said sewing machine towards a downstream side of said sewing machine, and to cause a needle to puncture said at least two fabric members at regular intervals and to draw said thread through said punctures, to form a sewn seam;

inserting a strip of thermoplastic polymer selected from the group consisting of polyurethane, nylon, polyester, polyolefin, and vinyl between said at least two fabric members while forming said sewn seam;

providing a plurality of heated, driven rollers;

providing a pair of idler rollers opposed to each of said driven rollers;

providing a continuous belt disposed over said idler rollers;

passing said at least two fabric members with said strip of polymer therebetween between said heated driven rollers and said pairs of idler rollers;

urging said heated driven rollers towards said pairs of idler rollers while said at least two fabric members are incrementally drawn from said upstream side of said sewing machine towards said downstream side of said sewing machine, so as to apply heat and pressure to said seam so as to melt said polymer from said thread, whereby said polymer from said thread fills said punctures, and so as to melt said polymer from said strip, allowing said polymer comprised by said thread to cool and solidify, whereby said punctures are sealed against ingress of water; and allowing said polymer of the strip to cool and solidify, whereby said seam between each puncture hole is sealed against ingress of water; and wherein at least two heated driven rollers are provided, their axes being generally coplanar, and wherein at least one downstream heated roller is driven at a greater speed than an upstream heated roller, whereby tension is exerted on the at least two fabric members.

2. The method of claim 1, wherein the thermoplastic polymer materials comprised by said thread and comprised by said strip are the same.

3. The method of claim 1, wherein said pairs of idler rollers are carried by a chassis fixed to said sewing machine.

4. The method of claim 3, wherein said chassis carries a further unheated roller over which said belt passes, the axis of said further unheated roller being movable to control the tension in said belt.

5. The method of claim 4, wherein said unheated roller is spring-biased to control the tension in said belt.

6. The method of claim 5, wherein when said driven rollers are engaged with said fabric members, said belt is deformed so as to urge said fabric members against a portion of the circumference of each of said driven rollers.

7. The method of claim 1, wherein the heated rollers are removed from contacting the fabric members except during sewing, to avoid scorching the fabric.

8. The method of claim 1, wherein three driven heated rollers are provided, and the downstream roller is driven faster than the upstream rollers, to exert tension on the fabric members.

* * * * *